US007229482B2

(12) United States Patent
May

(10) Patent No.: US 7,229,482 B2
(45) Date of Patent: Jun. 12, 2007

(54) METHOD OF REDUCING SMOKE AND PARTICULATE EMISSIONS FROM STEAM BOILERS AND HEATERS OPERATING ON SOLID FOSSIL FUELS

(75) Inventor: Walter R. May, Houston, TX (US)

(73) Assignee: SFA International, Inc., Houston, TX (US)

( * ) Notice: Subject to any disclaimer, the term of this patent is extended or adjusted under 35 U.S.C. 154(b) by 242 days.

(21) Appl. No.: 10/424,349

(22) Filed: Apr. 28, 2003

(65) Prior Publication Data

US 2003/0192488 A1 Oct. 16, 2003

Related U.S. Application Data

(63) Continuation-in-part of application No. 10/417,547, filed on Apr. 17, 2003, now Pat. No. 6,881,235, and a continuation-in-part of application No. 10/192,261, filed on Jul. 10, 2002, now Pat. No. 6,866,010.

(60) Provisional application No. 60/373,249, filed on Apr. 17, 2002, provisional application No. 60/304,579, filed on Jul. 11, 2001.

(51) Int. Cl.
*C10L 9/10* (2006.01)

(52) U.S. Cl. ..... 44/354; 44/363; 44/603; 123/1 A

(58) Field of Classification Search ..... 44/354–363, 44/457, 603, 365–367; 123/1 A
See application file for complete search history.

(56) References Cited

U.S. PATENT DOCUMENTS

| | | | | |
|---|---|---|---|---|
| 3,332,755 | A * | 7/1967 | Kukin | 44/603 |
| 3,615,292 | A | 10/1971 | Badin | |
| 3,891,401 | A | 6/1975 | Watson et al. | |
| 3,994,699 | A | 11/1976 | Scott | |
| 4,505,718 | A | 3/1985 | Dorer, Jr. | |
| 4,659,338 | A | 4/1987 | Johnston et al. | |
| 4,690,687 | A | 9/1987 | Johnston et al. | |
| 5,145,488 | A | 9/1992 | Weber et al. | |
| 5,266,082 | A | 11/1993 | Sanders | |
| 5,667,751 | A | 9/1997 | Taylor, Jr. | |
| 5,858,942 | A | 1/1999 | Adams et al. | |
| 5,944,858 | A | 8/1999 | Wallace | |
| 6,051,040 | A | 4/2000 | Peter-Hoblyn | |
| 6,488,725 | B1 | 12/2002 | Vincent et al. | |
| 6,866,010 | B2 * | 3/2005 | May | 123/1 A |
| 6,881,235 | B2 * | 4/2005 | May | 44/363 |

FOREIGN PATENT DOCUMENTS

| | | | |
|---|---|---|---|
| CN | 1222561 | A | 7/1982 |
| CN | 1076959 | * | 10/1993 |
| CN | 1184146 | | 6/1998 |
| GB | 2091291 | A | 7/1982 |
| GB | 2248068 | * | 3/1992 |

OTHER PUBLICATIONS

Edited by Eliot, Boiler Fuel Additives for Pollution Reduction and Energy Savings, 1978, pp. 67-72.
Rising, B., Particulate Emission Reduction Using Additives, Technical Paper TP-98010, Jan. 9, 1998, Westinghouse Power Corp., Orlando, FL 32826-2399.
Dr. Walter May, Combustion Turbine Exhause Particulate Emission Reduction: A Mechanistic Discussion, dated Jun. 2002.

* cited by examiner

*Primary Examiner*—Cephia D. Toomer
(74) *Attorney, Agent, or Firm*—Karen B. Tripp

(57) ABSTRACT

A method of reducing smoke and particulate emissions from steam boilers and process heaters operating on solid fuel by adding a fuel additive which contains an oil-dispersible iron compound and an over-based magnesium compound to the solid fuel.

2 Claims, No Drawings

METHOD OF REDUCING SMOKE AND PARTICULATE EMISSIONS FROM STEAM BOILERS AND HEATERS OPERATING ON SOLID FOSSIL FUELS

RELATED APPLICATIONS

This application is a continuation in part of the application with the U.S. Ser. No. 10/192,261 filed Jul. 10, 2002, now U.S. Pat. No. 6,866,010 which claimed priority to No. 60/304,579, filed Jul. 11, 2001 and a continuation in part of the application with the U.S. Ser. No. 10/417,547 filed Apr. 17, 2003, now U.S. Pat. No. 6,881,235 which claimed priority to Ser. No. 60/373,249, filed on Apr. 17, 2002, which hereby are incorporated by reference in their entirety.

BACKGROUND OF THE INVENTION

1. Technical Field

The present invention relates in general to a fuel additive that is a combustion catalyst for solid fossil fuel and in particular to a catalyst containing an over-based magnesium compound combined with a soluble iron compound. Such catalyst is particularly useful in heaters using coal or synfuel.

2. Description of the Prior Art

Concerns for the environment have led to more stringent restrictions on emissions from combustion of hydrocarbons, particularly from coal-burning equipment. Many techniques have been explored to reduce particulate emission, such techniques having various levels of success and various side effects. Typically, in the case of boilers, equipment design has been modified in order to minimize the emissions released. In addition to equipment design, various fuel sources have been evaluated for reduced emissions, including synfuel. Coal is also treated with various products to assist in dust control prior to combustion.

Emission controls additives have been researched in relation to liquid fuels. The use of fuel additives to reduce particulate emissions in liquid hydrocarbon combustion applications has been effective. In addition to tetraethyl lead for use in gasoline engines, several elements are known to have combustion catalyst characteristics useful for liquid hydrocarbon combustion chambers. Examples, are manganese, iron, copper, cerium, calcium and barium. Each of these elements has advantages and disadvantages in particular applications.

Other additives evaluated for use in liquid hydrocarbon have drawbacks including insolubility in hydrocarbons or lacking in the ability to create a dispersion in hydrocarbon liquid. Those additives that are water-soluble pose additional risks to the environment as spills or leaks from underground tanks could be hazardous to the environment.

In addition to iron, useful first row transition metals from the periodic table include manganese and copper. Also, various alkaline earth metals (barium, calcium) and others such as cerium, platinum and palladium have been tested. Manganese is used as a combustion catalyst in boilers with residual oil that often contains fuel contaminants, such as vanadium. Platinum and palladium, generally found in catalytic converters, are quite expensive. Manganese, when used alone, also forms low melting deposits and negates effects of magnesium on control of vanadium/sodium/calcium/potassium deposits. Iron catalyzes sulfur trioxide formation from sulfur dioxide increasing "cold end" corrosion (exhaust area) and sulfuric acid "rain" problems. Copper is less effective than either iron or manganese. Calcium forms tenacious deposits with other contaminant metals. Barium forms toxic salts. Cerium is not considered effective because of its higher elemental weight. These metals have been demonstrated to reduce smoke by no more than 50% at concentrations of up to about 50 PPM on a weight/weight basis by Environmental Protection Agency Test Method 5 (EPC M-5). While these metals have been evaluated in turbines and boilers, octane number is not at issue in this environment. Stability of the metal molecules is also not at issue and therefore not tested in boiler and turbines.

The effects of various metals listed above are known to improve combustion in boilers and combustion turbines and metals but these metals are known to vary ash quality. Tests run by this inventor indicate that improvement in emission controls can be achieved through the use of a mixture of magnesium and iron in a pre-selected ratio of about 5 parts magnesium to about 1 part by weight of iron. While some reduction in emissions from liquid hydrocarbon combustion was measured with this mixture, the reductions were low.

Over-based magnesium (Mg) compounds are known in the art for converting trace metal contaminants into high melting compounds and reducing deposits in combustion turbine engines operated by liquid petroleum fuels containing trace metal contaminants such as vanadium, lead, sodium, potassium and calcium. These contaminants form low melting corrosive deposits on hot metal parts in reciprocating engines, such as low-speed marine diesel engines. Magnesium is known to form high-melting salts with vanadium, sodium and other fuel contaminants. As a result, over-based magnesium compounds are used alone as fuel additives for compression-ignited reciprocating engines to reduce the effects of these contaminants.

A fuel additive for solid fossil fuel, such as coal, that includes a combustion catalyst to reduce smoke and particulate emissions from equipment that bums solid fossil fuels would be advantageous. A dispersible iron additive that remains stable during the combustion process would also be advantageous.

SUMMARY OF INVENTION

The present invention includes a method and fuel additive for reducing smoke and particulate emissions from heaters operating on solid fossil fuel. The invention includes a method of reducing smoke and particulate emissions from an exhaust of heating equipment operation on a solid fossil fuel. The heating equipment contains at least one combustion chamber. The solid fossil fuels is combusted in the heating chamber in the presence of a magnesium compound and an iron compound, also called a magnesium-containing compound and iron-containing compound, respectively. It is noted that where at least 30 ppm of iron are present, the emissions are notably reduced.

There are various ways of introducing the iron compound and the magnesium compound into the combustion chamber for combusting along with the solid fossil fuel. One method is pulverize the fuel along with the magnesium compound and iron compound prior to combustion so that a mix is introduced into the combustion chamber. Another preferred method includes introducing the iron compound and the magnesium compound to the solid fossil by dispersing the compounds into a liquid carrier to form a dispersion. The dispersion can then be applied to the solid fossil fuel. The dispersion can include a dispersion of one or both of the iron compound and the magnesium compound into the liquid carrier. The dispersion can also include partial or complete dissolving of the compounds into the liquid carrier such that iron and magnesium ions are dispersed within the liquid carrier. A preferred magnesium compound is magnesium oxide. Magnesium oxide can be ground and mixed with the solid fossil fuel. Magnesium oxide is also suitable for dispersion or dissolution in the liquid carrier. A preferred iron compound is iron oxide. Again, iron oxide can be ground and mixed with the solid fossil fuel or it can be dispersed or dissolved in the liquid carrier.

A preferred embodiment of the invention includes combusting the solid fossil fuel in the presence of the iron compound in the form of an oil-dispersible iron compound and in the presence of the magnesium compound in the form of an over-based magnesium compound. The oil-dispersible iron compound and the over-based magnesium compounds can be mixed to create an additive. This additive can be added to the solid fossil fuel prior to combustion or can be added into the combustion chamber during combustion. Injection is a preferred method of addition. Alternately, the oil-dispersible iron compound and the over-based magnesium compound can be added separately into the combustion chamber. It can be advantageous to apply either the oil-dispersible iron compound or the over-based magnesium compound to the solid fossil fuel prior to combustion and add the remaining compound during combustion.

In a preferred embodiment, the oil-dispersible iron compound is ferric naphthenate or iron naphtenate salt.

The invention includes a method of combustion of a solid fossil fuel in heating equipment whereby the emissions are decreased by at least 50% by weight as compared to the exhaust of the heating equipment without the introduction of the magnesium compound and the iron compound.

Use of the additive of the invention with hydrocarbons to be combusted also is a method of reducing NOx emissions from hydrocarbon-burning processes.

DETAILED DESCRIPTION OF THE PREFERRED EMBODIMENT OF THE PRESENT INVENTION

It has been shown and is therefore expected that iron behaves as a true catalyst based on kinetic theory. In related works of this author, including U.S. patent application Ser. No. 10/192,261, it has been found that oil-soluble iron combined with oil-soluble magnesium is a very effective combustion catalyst in compression-ignited (Diesel) reciprocating engines. The synergistic mixture of metals results in suppression of hydrocarbons in the exhaust (soot or smoke) and 8 to 12% increase in fuel efficiency. It has been found that the iron compound employed in this product does not disassociate or form iron sulfides. This observation is entirely unexpected as iron compounds typically exhibit negative side effects as discussed above. It appears that catalysis occurs from release of energy by electrons decaying from highly energized to degenerate orbitals. This is observed in the emission spectra of the element. An examination of the emission spectra of iron and magnesium demonstrates a reinforcement of the energy by non-duplicated primary spectra lines. It is believed that the mechanism of catalysis is that the reaction of hydrocarbon with oxygen to form carbon dioxide and water is rapidly quenched by dilution with air and reduced temperature. The energy from decaying electrons in the metal catalyst re-energizes the reaction process so that combustion is completed. This results in lower temperatures of operation and reduced NOx formation.

The preferred iron compound used in the formulation is ferric naphthenate. Naphthenic acid is an aliphatic carboxylic acid with a phenyl group on the end of the chain opposite the carboxyl group. Iron oxide is reacted therewith to create ferric naphthenate. The unsaturated ring will cause higher electron density in the carboxyl group with a lower ionization constant. The result is that the iron naphthenate does not disassociate readily in a hydrocarbon system, even in the presence of a strong Lewis acid such as a sulfide ion. The addition of this additive allows the use of cheaper grades of gasoline as these gasolines can be significantly improved and made useable by such addition.

Examples of heaters in which the present invention is useful includes industrial process heaters, refinery process heaters, industrial package-type steam boiler, utility field-directed steam boilers and the like. This invention is useful in any combustion process using solid fossil fuel. The additive contains an oil-dispersible iron compound and an over-based magnesium compound. The term "over-based" is defined below. In this form, the additive, also called composition, preferably shows the ratio of 5:1 iron to magnesium on a weight basis. A preferred embodiment includes the additive containing from about 3 parts to about 8 parts iron per about 1 part magnesium, by weight. Alternately, the fuel additive contains from about 4 parts to about 7 parts iron per about 1 part magnesium. When the fuel additive is added to the liquid petroleum fuel, the iron content is preferably in the range of 30–70 PPM by weight with 50 PPM being particularly preferred. Smoke and particulate emissions from combustion equipment is reduced by more than 50 percent through use of the enhanced fuel when compared to combustion of non-enhanced fuel. In the range of testing performed, results were often higher than 70 percent reduction and, in some cases, ranged as high as 80–92 percent reduction.

Previous commercial uses by the inventor with magnesium and iron combinations that were significantly lower in iron content provided decreases in emissions, but not substantial decreases. It was therefore surprising to observe the unexpected large emission decrease exhibited by the combination of iron and magnesium when iron content was increased to around 30 ppm. Based on conventional uses of iron as a catalyst, this behavior could not be predicted.

The additive of the invention also eliminates NOx formation as the fuel, without special adaptations, will burn at a lower temperature creating fewer pollutants.

Oil-soluble organic iron and magnesium compounds reduce smoke emission from combustion turbine exhausts by up to 80% at iron concentrations of up to 30 PPM when such engines are operated on petroleum fuels. This has been demonstrated in a combustion turbine engine, such as a Westinghouse Model 501-F 150 MW engine. Combustion turbine engines are known to produce an excessive amount of smoke emissions and particulate matter during the start-up cycle due to unstable combustion. This may be due to large-sized fuel droplets resulting in inefficient combustion. An iron oxide dispersion product is known to reduce smoke emissions in combustion turbine engines, along with the negative side effects noted above.

The very high activity of the iron-magnesium combination was entirely unexpected, especially at the 50 PPM iron (Fe) treatment level. An examination of the spectra of magnesium, iron, copper and manganese reveals that the spectra lines of magnesium compliment the spectra lines of iron. There are no duplicates or reinforcements. The magnesium spectra, by itself, do not yield energy in the areas that will continue burning of hydrocarbons after the temperature is quenched. However, it is believed that the magnesium spectra are synergistic with the spectra of iron to give an energy quanta (packets) that support and continue reaction of hydrocarbon with oxygen after the temperature is quenched below temperatures that would normally support combustion. Therefore, magnesium supports the catalytic effect of iron in a synergistic fashion that results in the additive being much more effective than iron alone. The longer burning time results in cooler temperatures resulting in lower NOx formation.

The composition of one embodiment of this invention is an oil-soluble iron compound and an over-based magnesium compound. This composition is believed to catalyze combustion of the solid fossil fuel when added to such fuel. The catalyzed combustion results in improved performance with reduced emissions and NOx.

The composition of this invention includes an additive, which contains about 3.0 to 8.0 parts iron, by weight for about 1.0 part magnesium, by weight. Preferably, from 4.0 to about 7.0 parts iron, by weight, for 1.0 part magnesium, by weight. More preferably, from about 5.0 parts iron, by weight, for about 1 part magnesium, by weight. Included in this ratio would be the test results of 5.5:1.1 ratio shown below.

The preferred over-based magnesium compounds of this invention are selected from carboxylate, sulfonate, acetic and mixtures thereof. The term "over-based" refers to the excess amount of base as compared with the acid of the solution, the acid being provided by the carboxylic acid, sulfonic acid or acetic acid of the preferred embodiment. The over-based magnesium compound preferred for this invention is magnesium oxide in a stable colloidal dispersion, the magnesium oxide being in such a proportion as to be greater than the amount that the acid of the additive solution could neutralize.

EXAMPLE 1

The composition can be formulated as a concentrate, which preferably contains about 5.5% iron, by weight, and about 1.1% magnesium, by weight. Dilutions of this concentrate can be made for convenience of use.

EXAMPLE 2

The oil-soluble iron compound of this invention may be prepared in a single batch in laboratory quantities. The apparatus required is a 3-Neck round bottom 1,000 ml. flask, heating mantle, temperature controller, 0–400° C. thermometer, stirrer center mounted with a motor and controller, condenser and vacuum pump with trap.

The reactants are as follows:

| | |
|---|---|
| Iron Oxide | 79 gms. |
| Carboxylic acid (MW > 200) | 720 gms |
| High Boiling Process Solvent | 215 gms |

The apparatus is assembled with the thermometer in one outside neck and stirrer in the center. Connect a condenser to the flask in the reflux position. Add high boiling solvent, carboxylic acid (>200 MW) to the reactor. Heat to 90° C. Add iron oxide and heat to 110° C. Add carboxylic acid (>45 MW) and heat to 140° C. Reflux for one hour. Remove water of reaction with the carboxylic acid. Heat to >200° C. until high boiling solvent and water is removed. When water stops evolving, place the condenser in the distillation position, apply vacuum and remove remaining solvent. Return high boiling solvent and/or HAN or No. 2 fuel to reach desired iron concentration.

EXAMPLE 3

The over-based magnesium compound of this invention can be prepared in a single batch in laboratory quantities. The apparatus required is a 3-Neck round bottom 1,000 ml. flask, heating mantle, temperature controller, 0–400° C. thermometer, center-mounted stirrer with a motor and controller, condenser and vacuum pump with trap. The reactants are as follows:

| | |
|---|---|
| Magnesium hydroxide | 195 gms. |
| Sulfonic acid (MW > 200) | 37 gms. |
| Carboxylic acid (MW > 200) | 99 gms. |
| Carboxylic acid (MW > 45) | 2 gms. |
| High Boiling Process Solvent | 215 gms. |
| High aromatic solvent | 138 gms. |

The apparatus is assembled with the thermometer in one outside neck, stirrer in the center. Connect the condenser to the flask in the reflux position. Add high boiling solvent, carboxylic acid (>200 MW) and sulfonic acid to the reactor. Heat to 90° C. Add magnesium hydroxide and heat to 110° C. Add carboxylic acid (>45 MW) and heat to 140° C. Reflux for one hour. Remove water of reaction with the carboxylic acids. Heat to >280° C. until high boiling solvent and water is removed. When water stops evolving, place the condenser in the distillation position, apply vacuum and remove remaining solvent. Return high boiling solvent and/or HAN or No. 2 fuel to reach desired magnesium concentration.

While the degree of purity of the additive has not been examined for effect, the additive was created as described above to achieve high purity for purposes of scientific testing.

The present invention has several advantages. Smoke and particulate emissions from equipment using solid fossil fuel are reduced dramatically, based on visual observations, using the method and oil-soluble iron and over-based magnesium composition of this invention. In empirical field tests, there has been no evidence of maintenance problems or damage to metal equipment as a result of using the composition of this invention.

This invention avoids the use of toxic metals such as lead or vanadium in exhausts. Ferric oxide resulting from combustion of the additive is rust, a widely prevalent material in nature that is totally benign to biological life forms. Ferric sulfide precipitate is also avoided. The iron naphthenate and the magnesium oxide combination is non-toxic and non-carcinogenic in normal applications. While ingestion and prolonged contact with skin is not recommended, the material can be washed off skin with soap and water, and safely eliminated from the body with emetics. Other methods of practicing the invention would be other chemical forms of the product and introducing to the fuel through different techniques.

While the present invention has been described and/or illustrated with particular reference to a composition and method to reduce exhaust in equipment using solid fossil fuel, it is noted that the scope of the present invention is not restricted to the particular embodiment(s) described. It should be apparent to those skilled in the art that the scope of the invention includes the use of the fuel additive in other reciprocating engines than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A method of reducing smoke and particulate emissions from an exhaust of heating equipment operating on a solid fossil fuel and containing a combustion chamber, comprising the step of: combusting the solid fossil fuel in the presence of an oil-dispersible iron compound and an over-based magnesium compound such that at least 30 ppm of iron are present, wherein iron and magnesium are present in a ratio of about 4 parts to about 7 parts of iron per about 1 part of magnesium, by weight.

2. A method of reducing smoke and particulate emissions from an exhaust of heating equipment operating on a solid fossil fuel and containing a combustion chamber, comprising the step of: combusting the solid fossil fuel in the presence of an oil-dispersible iron compound and an over-based magnesium compound such that at least 30 ppm of iron are present, wherein iron and magnesium are present in a ratio of about 5 parts of iron per about 1 part of magnesium, by weight.

* * * * *